US008455164B2

(12) United States Patent
Anno et al.

(10) Patent No.: US 8,455,164 B2
(45) Date of Patent: Jun. 4, 2013

(54) DEVELOPER FOR ELECTROPHOTOGRAPHY

(75) Inventors: Masahiro Anno, Tokyo (JP); Tsuyoshi Uchida, Tokyo (JP); Masahiko Nakamura, Tokyo (JP); Kenichi Onaka, Tokyo (JP); Junya Onishi, Tokyo (JP); Naoya Tonegawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 345 days.

(21) Appl. No.: 12/745,123

(22) PCT Filed: Jul. 3, 2009

(86) PCT No.: PCT/JP2009/062195

§ 371 (c)(1),
(2), (4) Date: May 27, 2010

(87) PCT Pub. No.: WO2010/007905

PCT Pub. Date: Jan. 21, 2010

(65) Prior Publication Data

US 2012/0009515 A1 Jan. 12, 2012

(30) Foreign Application Priority Data

Jul. 18, 2008 (JP) ..... 2008-186830

(51) Int. Cl.
*G03G 9/08* (2006.01)

(52) U.S. Cl.
USPC ..... 430/108.6; 423/598; 428/402; 977/773

(58) Field of Classification Search
USPC ..... 430/108.6; 423/598; 428/402; 977/773
See application file for complete search history.

(56) References Cited

U.S. PATENT DOCUMENTS

| | | | | |
|---|---|---|---|---|
| 8,093,171 | B2 * | 1/2012 | Higashi et al. | 501/134 |
| 2005/0260515 | A1 * | 11/2005 | Kato et al. | 430/108.6 |
| 2008/0032224 | A1 * | 2/2008 | Kikawa et al. | 430/109.3 |
| 2008/0050669 | A1 * | 2/2008 | Ohmura et al. | 430/109.4 |
| 2010/0233607 | A1 * | 9/2010 | Asano et al. | 430/108.6 |

FOREIGN PATENT DOCUMENTS

| | | |
|---|---|---|
| JP | 02-150858 | 6/1990 |
| JP | 05-224454 | 9/1993 |
| JP | 08-202078 | 8/1996 |
| JP | 08248674 | 9/1996 |

(Continued)

OTHER PUBLICATIONS

PCT International Preliminary Report on Patentability.

*Primary Examiner* — Mark F Huff
*Assistant Examiner* — Rachel Zhang
(74) *Attorney, Agent, or Firm* — Lucas & Mercanti, LLP

(57) ABSTRACT

The present invention provides a developer for electrophotography which is superior in property of build up of electrification and in charge stability even in environments of high temperature and high humidity or in an environment of low temperature and low humidity where it is difficult for a developer to retain its electrostatic charge performance, and which can provide an image free from fogging and decrease in density for a long term, that is, a developer for electrophotography containing composite oxide particles which include metal titanate particles containing titanium as a first metal atom and a second metal atom and containing therein 0.009 to 0.350% by weight of a third metal atom selected from the group consisting of the metal atoms belonging to Group 5A of the long form of the periodic table of elements.

10 Claims, 1 Drawing Sheet

FOREIGN PATENT DOCUMENTS

| | | | |
|---|---|---|---|
| JP | 10-048872 | | 2/1998 |
| JP | 10-142831 | | 5/1998 |
| JP | 200584295 | | 3/2005 |
| JP | 2005181490 | | 7/2005 |
| JP | 2006309176 | | 11/2006 |
| JP | 2007-094232 | | 4/2007 |
| WO | WO 2007086602 | * | 8/2007 |
| WO | WO 2009035166 | * | 3/2009 |

* cited by examiner

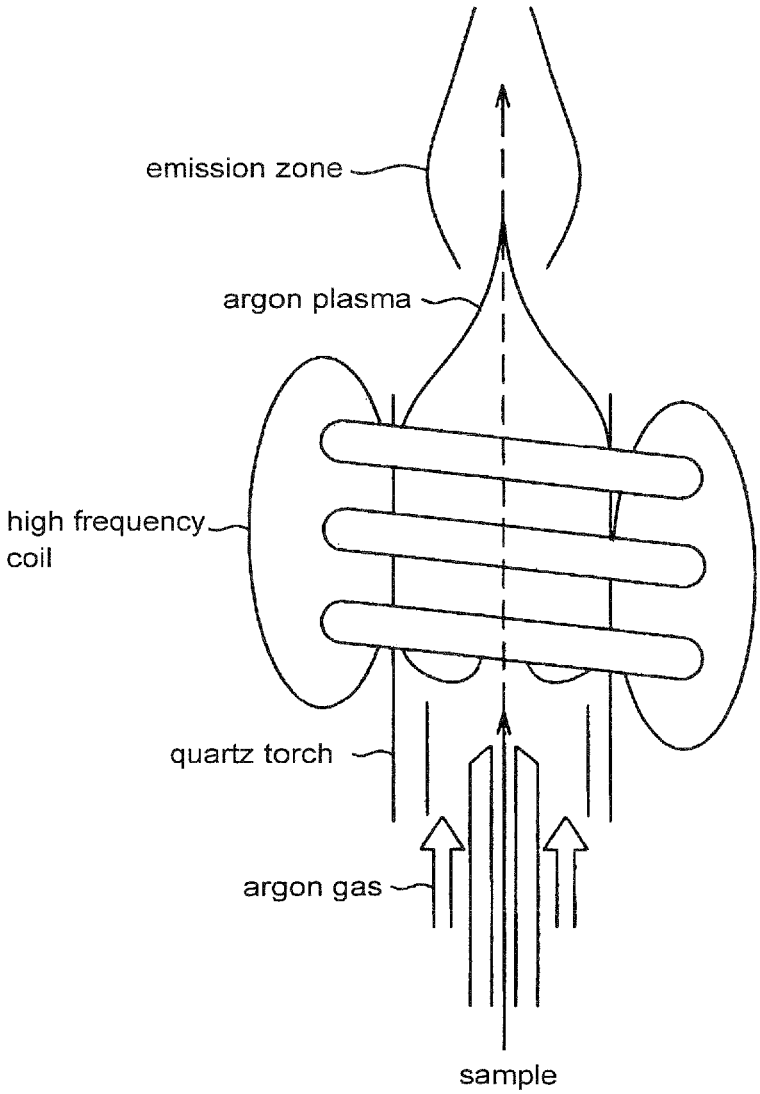
emission zone
argon plasma
high frequency coil
quartz torch
argon gas
sample

DEVELOPER FOR ELECTROPHOTOGRAPHY

CROSS REFERENCE TO RELATED APPLICATION

This is a U.S. National Phase Application under 35 U.S.C. 371 of International Application PCT/JP2009/062195, filed Jul. 3, 2009, which claims the priority of Japanese Application No. 2008-186830, filed Jul. 18, 2008, the entire content of both Applications are hereby incorporated by reference.

TECHNICAL FIELD

The present invention relates to a developer for electrophotography which is used for an electrophotographyic image-forming apparatuses.

BACKGROUND ART

It is known that a metal titanate typified by calcium titanate or strontium titanate is added to a developer for electrophotography (Patent Documents 1 and 2). The reason for adding a metal titanate is that the metal titanate not only contributes to the prevention of occurrence of filming on the surface of a photosensitive member during image formation and the improvement in a cleaning property but also contributes to the improvement in electrostatic property because of its high-dielectricity.

However, a sufficient effect of improving the electrostatic property is not achieved even though metal titanate is added. For example, since metal titanate has relatively high resistance, the property of build up of electrification is low in an environment of low temperature and low humidity, even though metal titanate is added to the developer for electrophotography, and since metal titanate has high saturation charge amount, a toner having a high charge amount which has been adequately mixed and stirred and a toner having a low charge amount which has been rapidly supplied tend to be present together to broaden distribution of the charge amount in the case where images having a high coverage rate are printed after print images having a low coverage rate have been printed continuously, resulting in fogging or toner flying occurred or image density of a solid image was reduced. On the other hand, if the developer contains particles having low resistance for the purpose of improving problems in an environment of low temperature and low humidity, it was impossible to maintain good electrostatic property in an environment of high temperature and high humidity, and fogging occurred or the transfer property was deteriorated to reduce image density of a solid image when, for example, the developer was left standing for a long term.

PRIOR ART DOCUMENT

Patent Document

Patent Document 1: JP-A No. Hei 8-248674
Patent Document 2: JP-A No. 2005-181490

DISCLOSURE OF INVENTION

Technical Problems to be Solved

It is an object of the present invention to provide a developer for electrophotography which is superior in charge stability and can provide an image free from fogging and decrease in density for a long term even in an environment of high temperature and high humidity where it is difficult for a developer to retain its electrostatic charge performance or in an environment of low temperature and low humidity where the property of build up of electrification tends to be deteriorated.

Means to Solve the Problems

The present invention relates to a developer for electrophotography containing composite oxide particles which includes metal titanate particles containing titanium as a first metal atom and a second metal atom and containing therein 0.009 to 0.350% by weight third metal atom selected from the group consisting of the metal atoms belonging to Group 5A of the long form of the periodic table of elements.

In the present specification, a toner is formed by adding an external additive to toner particles externally and the toner is differentiated from the toner particles.

Effects of the Invention

Since the developer for electrophotography of the present invention is superior in property of build up of electrification and in charge stability even in an environment of high temperature and high humidity or an environment of low temperature and low humidity, it can retain excellent electrostatic property for a long term from the initial stage without causing excessive electrification. Consequently, the developer for electrophotography of the present invention can provide an image free from fogging and decrease in density for a long term.

BRIEF DESCRIPTION OF THE DRAWINGS

FIG. 1 is a schematic view of inductively coupled plasma-atomic emission spectroscopy.

BEST MODE FOR CARRYING OUT THE INVENTION

The developer for electrophotography of the present invention contains a specific composite oxide particle.

Composite Oxide Particle

In the present invention, the composite oxide particle is formed by including a predetermined third metal atom in an appropriate amount in a particle of a metal salt of titanic acid containing a titanium atom as a first metal atom with a second metal atom. When the predetermined third metal atom is contained in the metal titanate particle in an appropriate amount, it is believed that since the composite oxide particle spuriously acts as a carrier or a capacitor when contacting with the toner at the time of development, and therefore the property of build up of electrification and the charge stability are improved. For example, in an environment of high temperature and high humidity where leakage of electric charges tends to occur, even though the third metal atom exists in the composite oxide particle, proper electrostatic property can be maintained without causing leakage if the content of the third metal atom is in a proper range. Initial electrostatic property of toner can be stably maintained since electric charges capable of acting spuriously as a carrier and forming a predetermined level of images are supplied to the toner. For example, in an environment of low temperature and low humidity where the toner tends to be excessively charged, since the composite oxide particle spuriously acts as a capacitor to once accumulate toner charges excessively charged and then releases the toner charges quickly through third metal atom, the toner electrostatic property can be stably maintained. There is a tendency to decrease the ability of the toner to be quickly charged in the environment of low temperature and low humidity, but since the composite oxide particle spuriously acts as a carrier through the existence of the third metal atom, good property of build up of electrification can be attained. As these results, it is believed that since the composite oxide particle can maintain the excellent electrostatic property for a long term from the initial stage, it is possible to attain an image free from fogging and decrease in density for a long term even in an environment of high temperature and high humidity or an environment of low temperature and low humidity.

The composite oxide particle may have a structure in which the third metal atom is captured in a crystal lattice of metal titanate as a part of lattice point, or may have a structure in which the third metal atom is contained in a state of an oxide between crystal lattices of the metal titanate, or may have a complex structure thereof.

The metal titanate containing the third metal atom is a metal salt of titanic acid containing a titanium atom as a first metal atom with a second metal atom. The second metal atom is one or more kinds of metal atoms selected from the group consisting of the metal atoms belonging to Groups 1A and 2A of the long form of the periodic table of elements. Specific examples of the metal atoms belonging to Group 1A include Li, Na and K. Specific examples of the metal atoms belonging to Group 2A include Mg, Ca, Sr and Ba. The second metal atom which is preferred from the viewpoint of further improving the property of build up of electrification and the charge stability is the metal atom belonging to Group 2A, and the second metal atom is more preferably selected from Mg, Ca, Sr and Ba, and furthermore preferably selected from Mg and Ca.

Such a metal titanate refers to a salt produced from titanium (IV) oxide and an oxide or carbonate of the second metal atom, and the salt is referred to as metatitanate and can be represented by the general formula (I):

$$M^{I}_{2}TiO_3 \text{ or } M^{II}TiO_3, \qquad \text{general formula (I);}$$

wherein $M^{I}$ represents a metal atom of Group 1A and $M^{II}$ represents a metal atom of Group 2A.

Specific examples of metal titanate containing the third metal atom include calcium titanate $CaTiO_3$, magnesium titanate $MgTiO_3$, strontium titanate $SrTiO_3$ and barium titanate $BaTiO_3$. Among these titanates, calcium titanate $CaTiO_3$ and magnesium titanate $MgTiO_3$ are preferred from the viewpoint of influences on environment, and calcium titanate $CaTiO_3$ is particularly preferred since it maintains a charge amount at a constant level for a long term.

The third metal atom contained in metal titanate is one or more kinds of metal atoms selected from the group consisting of the metal atoms belonging to Group 5A of the long form of the periodic table of elements. Specific examples of the metal atoms belonging to Group 5A include vanadium (V), niobium (Nb) and tantalum (Ta), particularly Nb.

A content of the third metal atom in the composite oxide particle is 0.009 to 0.350% by weight, and it is preferably 0.03 to 0.30% by weight, and particularly preferably 0.08 to 0.25% by weight from the viewpoint of further improving the property of build up of electrification and the charge stability. When the content of the third metal atom is too low, since the build up of electrification is slow in an environment of low temperature and low humidity and excessive charging occurs during durability, fogging or toner flying occurs and the image density of a solid image is reduced. When the content of the third metal atom is too high, the charge retention property in an environment of high temperature and high humidity is deteriorated to cause reduction in charge amount and fogging is increased.

In the present specification, the content of the third metal atom in the composite oxide particle is represented as a proportion to the whole metal atoms contained in the composite oxide particle, and it can be measured with an inductively coupled plasma-atomic emission spectroscopy apparatus (ICP-OES) schematically shown in FIG. 1. ICP-OES excites a sample with a plasma flame produced by irradiating argon gas with a high frequency, and the identification or quantification of an element is performed from an emission spectrum at the time when the sample returns to a ground state.

In the measuring method of the third metal atom, specifically, first, 1 g of the composite oxide particles to be measured is taken and put in a 200 ml dried conical beaker. Sulfuric acid (20 ml) is added as a decomposition reagent, and the resulting mixture is decomposed by a microwave using a microwave wet-decomposition apparatus of a sealing type (MLS-1200 Mega; made by Milestone Inc.) and the resulting product is cooled. The decomposition by a microwave is continued until an undissolved substance disappears. The decomposition solution is put in a 100 ml measuring flask, and distilled water is filled to a marked line of the flask to prepare 100 ml of a sample solution. The solution (25 ml) is taken from the sample solution and put in a 100 ml measuring flask, and distilled water is filled to a marked line of the flask to prepare 100 ml of a sample solution. The resultant sample solution is subjected to ICP-OES described above and the intensity of spectrum at a wavelength inherent in an atom is measured and quantified using a calibration curve. Wavelengths inherent in the third metal atoms are, for example, 269.706 nm (Nb), 309.311 nm (V), and 226.230 nm (Ta).

A calibration curve can be made by the following method. The composite oxide particle (for example, metal titanates such as calcium titanate, strontium titanate, magnesium titanate) not containing the third metal atom is decomposed by a microwave as described above, and the decomposition solution is put in a 100 ml measuring flask. Distilled water is filled to a marked line of the flask to prepare 100 ml of a sample solution. The solution (25 ml) is taken from the sample solution and put in a 100 ml measuring flask, and a standard solution of the third metal atom is added so as to be 0 ppm, 1 ppm, 2 ppm, and 3 ppm in concentration respectively, and the distilled water is filled to a marked line of the flask to give 100 ml of samples for preparing a calibration curve. A calibration curve is prepared from the above four concentration points for each composite oxide particle.

The composite oxide particles have a number average particle size of 30 nm or more and 3000 nm or less, preferably 50 nm or more and 2000 nm or less, and furthermore preferably 50 nm or more and 4000 nm or less. In the present invention, by using the composite oxide particles having a particle size in the above range, the excellent property of build up of electrification and the excellent charge stability of the toner can be more stabilized. As the reason for this, it is believed that when the value of the number average particle size of the composite oxide particles is in the above range, a moderate contact area between the composite oxide particle and the toner, through which the charge is easily transferred, is secured to form a field to facilitate charge transfer between the composite oxide particle and the toner. Particularly in the case where the composite oxide particles are added to the toner particles as an external additive, if the number average particle size of the composite oxide particles is in the above range, a state, in which the composite oxide particle firmly adheres to the surface of the toner particle, is prevented and simultaneously the separation of the composite oxide particle from the toner particle is also prevented, and therefore this contributes to an improvement in toner fluidity and the property of build up of electrification and the charge stability of the toner can be more effectively improved.

The number average particle size of the composite oxide particles can be calculated, for example, by an electron micrograph. Specifically, the number average particle size can be calculated according to the following procedure.

(1) A scanning electron micrograph of composite oxide particles isolated from a developer is taken at a magnification of 30000 times and an image of this micrograph is captured by a scanner.

(2) By an image processing and analyzing apparatus "LUZEX AP (made by Nireco Corporation)", the composite oxide particles existing at the surface of a toner on the image of the micrograph is binarized, and horizontal Feret's diameters of 100 particles are calculated and an average of the horizontal Feret's diameters is defined as an average particle size. Here, the horizontal Feret's diameter refers to a distance between two vertical lines at the time when the composite oxide particle on the image of the micrograph is sandwiched between two vertical lines.

The composite oxide particles preferably have a standard deviation value of the particle size of 1000 nm or less, particularly 500 nm or less, and furthermore preferably 250 nm or less. It is believed that by using the composite oxide particles having a standard deviation of particle size in the above range, since the composite oxide particles being used do not exhibit variations in performance to contribute to charging and every composite oxide particle exhibits the same level of electrostatic charge performance for the toner, this effectively contributes to realization of uniform charging of the toner.

The standard deviation (SD value) of particle size represents a particle size distribution on a number basis of the composite oxide particles, and it can be obtained by measuring the 84% particle size on a number basis and the 16% particle size on a number basis of the composite oxide particles by a method similar to the above-mentioned measurement of the number average particle size, and dividing the difference therebetween by 2. That is, the standard deviation (SD value) of particle size of the composite oxide particles is represented by the following equation:

Standard deviation (SD value) of particle size=(84% particle size on a number basis ($D84$)−16% particle size on a number basis ($D16$))/2.

A BET specific surface area of the composite oxide particles is 3 $m^2/g$ or more and 30 $m^{2/9}$ or less, and particularly the composite oxide particle having a BET specific surface area of 5 $m^2/g$ or more and 25 $m^2/g$ or less is preferred.

The BET specific surface area refers to the specific surface area of a particle calculated by a gas adsorption method, and in the calculation of the specific surface area of a particle by a gas adsorption method, a gas molecule, an adsorption area of which is known like a nitrogen gas, is adsorbed on the particle, and the specific surface area of the particle is calculated from the adsorption amount of the gas. In the BET specific surface area, an amount of a gas molecule directly adsorbed on the surface of solid (an adsorbed amount of a monomolecular layer) can be exactly calculated. The BET specific surface area can be calculated using the following formula, referred to as a BET equation. As shown in the following formula, the BET equation shows a relationship between an adsorptive equilibrium pressure P at the time when adsorption is in an equilibrium state under the condition of a constant temperature and an adsorption amount V at the pressure, and the BET equation is represented as follows.

$$P/V(Po-P)=(1/VmC)+((C-1)/VmC)(P/Po) \quad \text{Formula 1:}$$

in which

Po: saturated vapor pressure,

Vm: adsorption amount of a monomolecular layer, that is, an adsorption amount at the time when gas molecules form a monomolecular layer on the surface of solid.

C: parameter related to adsorption heat (>0)

The adsorption amount of monomolecular layer Vm is calculated from the above equation, and by multiplying the Vm by a cross-sectional area covered by one gas molecule, the surface area of the particle can be calculated.

The BET specific surface area is calculated according to the following measuring method using automatic surface area analyzer "GEMINI 2360 (made by Shimadzu Corporation, Micromeritics Instrument Corporation)

First, 2 g of composite oxide particles were charged into a straight sample cell and the inside of the cell is replaced with a nitrogen gas (purity: 99.999%) for 2 hours as a pretreatment. After the replacement, the nitrogen gas (purity: 99.999%) is adsorbed and desorbed on the composite oxide particles pretreated in the analyzer main body, and the BET specific surface area is calculated by a multipoint method (seven point method).

A molar ratio of the second metal atom to the first metal atom (second metal atom/first metal atom (titanium atom)) in the composite oxide particles, particularly Ca/Ti, is preferably 0.9 to 1.3, more preferably 1.0 to 1.2, and furthermore preferably 1.1 to 1.15.

The molar ratio of second metal atom/first metal atom, particularly Ca/Ti, can be measured by elemental analysis using a fluorescent X-ray.

The content of the composite oxide particle in the developer is not particularly limited as long as the object of the present invention is achieved, and for example, the content is generally 0.1 to 10.0% by weight with respect to the whole developer. The preferable range of the content varies depending on the form of the composite oxide particle to be contained and this form will be described later. When the composite oxide particle is contained in the developer in two or more forms, which will be described later, the total content may be in the above-mentioned range.

The composite oxide particle can be produced by adding a predetermined amount of the supply source of the third metal atom to raw materials in a publicly known production method of metal titanate (titanate of the second metal atom). For example, titanium (IV) oxide hydrate ($TiO_2.H_2O$) taking the form of hydrate referred to as metatitanic acid is obtained through hydrolysis by the so-called sulfuric acid method. Such a titanium (IV) oxide hydrate, the supply source of the second metal atom, and the supply source of the third metal atom are mixed, and to the mixed solution, an alkaline aqueous solution is added at a temperature of 50° C. or higher to react the mixed solution, and the reactant is calcined to obtain the composite oxide particles.

Titanium (IV) oxide is not limited to one prepared by the sulfuric acid method, and the one prepared by another publicly known method may be used. A hydrolysate of titanium oxide typified by metatitanic acid obtained by a hydrolyzing treatment in the sulfuric acid method is also referred to as a mineral acid deflocculated product, and has the form of liquid in which titanium oxide particles are dispersed. Metatitanic acid obtained by the sulfuric acid method, which is one typical example of the mineral acid deflocculated product, contains sulfurous acid $SO_3$ in an amount of 1.0% by weight or less, preferably 0.5% by weight or less, and is deflocculated by adjusting its pH to 0.8 to 1.5 with hydrochloric acid. The concentration of the titanium oxide hydrolysate is 0.05 to 1.0 mol/liter, and preferably in the range of 0.1 to 0.8 mol/liter in terms of $TiO_2$.

As a supply source of the second metal atom, a carbonate, an oxide, a nitrate, and a chloride of metals belonging to Group 1A and Group 2A can be used, and particularly a water-soluble compound of these is suitably used. Specific examples of the compound include calcium carbonate, calcium oxide, calcium nitrate, calcium chloride, magnesium carbonate, magnesium oxide, magnesium nitrate, magnesium chloride, strontium carbonate, strontium oxide, strontium nitrate, strontium chloride, barium carbonate, barium oxide, barium nitrate, barium chloride, lithium carbonate, lithium oxide, lithium nitrate, lithium chloride, sodium carbonate, sodium oxide, lithium nitrate, lithium chloride, potassium carbonate, potassium oxide, potassium nitrate and potassium chloride. An addition ratio (molar ratio) of the supply source of the second metal atom to titanium oxide is 0.9 to 1.4, and preferably in the range of 0.95 to 1.15 in the case where the second metal atom is a metal atom belonging to Group 2A. An addition ratio (molar ratio) of the supply source of the second metal atom to titanium oxide hydrolysate is 1.8 to 2.8, and preferably in the range of 1.9 to 2.3 in the case where the second metal atom is a metal atom belonging to Group 1A.

A supply source of the third metal atom is not particularly limited as long as it is a compound containing the third metal atom, and examples thereof include niobium oxide, niobium hydroxide, vanadium oxide, vanadium hydroxide, tantalum oxide and tantalum hydroxide. The supply source of the third metal atom may be used in powder form, or may be used in the form of slurry prepared by dispersing the supply source of the third metal atom in water in advance. An addition ratio (molar ratio) of the supply source of the third metal atom is not particularly limited as long as the composite oxide particle containing the above-mentioned content of the third metal atom is obtained. For example, when the supply source of the third metal atom is an oxide, the addition ratio thereof is commonly 0.0009 to 0.035 mol with respect to 1 mol of the titanium oxide hydrolysate. When the supply source of the third metal atom is an other compound such as an hydroxide, the addition ratio thereof may be appropriately adjusted according to the number of the third metal atoms in 1 mol of said other compound, based on the above-mentioned addition ratio in the case where the supply source of the third metal atom is an oxide. By adjusting such addition ratio, it is possible to control the content of the third metal atom in the composite oxide particle.

As an alkaline aqueous solution which is used in a method of producing composite oxide particles, a caustic alkaline aqueous solution typified by an aqueous solution of sodium hydroxide is preferably used. When a temperature of the reaction system at the time of adding an alkaline aqueous solution is higher, more crystalline particles can be obtained, but it is practically proper that the temperature of the reaction system is in the range of 50 to 101° C. A rate of addition of the alkaline aqueous solution tends to affect a particle size of the composite oxide particle to be obtained, and when the rate of addition is low, the composite oxide particle obtained tends to have a larger particle size, and when the rate of addition is high, the composite oxide particle obtained tends to have a smaller particle size. The rate of addition of the alkaline aqueous solution is 0.001 to 1.0 equivalent/h, preferably 0.005 to 0.5 equivalents/h with respect to a charge stock, and the rate of addition can be appropriately adjusted according to a desired particle size. The rate of addition of the alkaline aqueous solution can be changed in a mid-course phase in accordance with the purpose.

In the method of producing composite oxide particles, the particle size of the composite oxide particle can also be controlled by adjusting the addition ratio of the supply source of the second metal atom to titanium oxide hydrolysate, the concentration of the titanium oxide hydrolysate at the time of reaction, and the temperature at the time of adding an alkaline aqueous solution.

In a reaction step, it is preferred to perform the reaction in a nitrogen gas atmosphere in order to prevent the generation of a carbonate compound.

The resulting composite oxide particles may be used as they are, but it is preferred to apply a hydrophobizing treatment to the composite oxide particles for adjusting electrostatic property of a toner to be obtained or for improving stability of charging environment.

Examples of a hydrophobizing treatment method include a dry process in which a hydrophobizing agent is used singly or as a diluted solution prepared by dissolving the hydrophobizing agent in an organic solvent such as tetrahydrofuran (THF), toluene, ethyl acetate, methyl ethyl ketone or acetone and the hydrophobizing agent or the diluted solution thereof is dropped or added in a spray form while forcibly stirring the powdery composite oxide particles with, for example, a blender and the resulting mixture is adequately mixed, and a wet process such as a method in which the composite oxide particles are immersed in a solution prepared by dissolving a hydrophobizing agent in an organic solvent and the resulting mixture is adequately mixed or a method in which a desired hydrophobizing agent is dispersed in a water-based medium and the composite oxide particles are immersed in the water-based medium in which the hydrophobizing agent has been dispersed, adequately mixed with the water-based medium, and then the mixture is dried and pulverized. These dry and wet methods may be used in combination. Among these methods of hydrophobizing treatment, the wet method in which the hydrophobizing agent is dispersed in a water-based medium and the composite oxide particles are immersed in the water-based medium is preferred from the viewpoints of improvement in the uniformity of hydrophobizing treatment on the composite oxide particles, safety and cost, and a wet method, in which an hydrophobizing agent in a water-based emulsion form is used and the composite oxide particles are subjected to a hydrophobizing treatment in a water-based medium, is more preferred.

As the hydrophobizing agent used for the hydrophobizing treatment, hydrophobizing agents, which have been conventionally used for inorganic oxides such as $SiO_2$ and $Al_2O_3$, are used, and examples thereof include various coupling agents such as silane-based coupling agents, for example, chlorosilane, alkylsilane, alkoxysilane and silazane, titanate-based coupling agents, aluminum-based coupling agents and zircoaluminate-based coupling agents etc.; and silicone oil and stearic acid. As the hydrophobizing agent, silicone oil is particularly preferred.

Specific examples of products which can be suitably used as a water-based emulsion of a silicone oil include dimethylpolysiloxane-based emulsion such as "SM 7036EX", "SM 7060EX", "SM 8706EX" (all made by Dow Corning Toray Silicone Co., Ltd.); amino-modified silicone emulsion such as "SM 8704", "SM 8709", "BY 22 819" (all made by Dow Corning Toray Silicone Co., Ltd.); carboxyl-modified silicone emulsion such as "BY 22 840" (made by Dow Corning Toray Silicone Co., Ltd.); and phenylmethyl silicone emulsion such as "SM 8627EX" (made by Dow Corning Toray Silicone Co., Ltd.).

An addition amount of the hydrophobizing agent, while varying depending on the kinds of the composite oxide, is preferably 0.1 to 5.0% by mass, and more preferably 0.2 to 3.0% by mass with respect to the composite oxide particles.

When the addition amount of the hydrophobizing agent is less than 0.1% by mass, there is a possibility that an adequate effect of hydrophobization is not achieved, and on the other hand, when the addition amount of the hydrophobizing agent is more than 5.0% by mass, the hydrophobizing agent exists excessively to the composite oxide particles to be treated, and there is a possibility that the hydrophobizing agent which does not contribute to a hydrophobizing treatment of the surface of the composite oxide particle is discharged together with the dispersion medium or the hydrophobizing agents aggregate, and whereby a production system or an image-forming apparatus may be contaminated.

Developer

The developer of the present invention may be a two-component developer including a toner formed by adding an external additive to toner particles externally and a carrier, or may be a mono-component developer including a toner formed by adding an external additive externally to toner particles as long as the developer contains composite oxide particles.

The form in which the composite oxide particles in the developer of the present invention are contained is not particularly limited as long as the contact between the composite oxide particles and the toner particles is secured, and for example, when the developer is a two-component developer, the composite oxide particles are contained in at least one of the forms described below:

(A1) the composite oxide particles are added externally to toner particles;

(A2) the composite oxide particles are added internally into toner particles;

(A3) the composite oxide particles are added internally into carrier;

(A4) the composite oxide particles are added externally to carrier; and (A5) the composite oxide particles are added to a developer as a third component.

For example, when the developer is a mono-component developer, the composite oxide particles are contained in at least one of the forms described below:

(B1) the composite oxide particles are added externally to toner particles; and (B2) the composite oxide particles are added internally into toner particles.

In the present invention, it is preferred that the composite oxide particles are contained in the developer in the form of (A1) or (B1) from the viewpoint of stably exhibiting the effects efficiently and stably.

Embodiments of the developer of the present invention will be described.

Embodiment 1

A developer of Embodiment 1 contains composite oxide particles in the form of (A1), that is, it is a two-component developer in which composite oxide particles are added externally to toner particles. In the present embodiment, the contact between the toner particles and the composite oxide particles added externally to the toner particles is secured and the excellent property of build up of electrification and the excellent charge stability of the toner are exhibited with more reliability.

In the present specification, "being added externally to toner particle" means being added to and mixed with toner particles obtained once.

In Embodiment 1, a content of the composite oxide particle is not particularly limited as long as the content with respect to the whole developer is in the above-mentioned range, and in general, it is preferably 0.1 to 10.0% by weight, and particularly 0.3 to 5.0% by weight with respect to the toner particles. More preferably, the content is 0.4 to 2.0% by weight.

A method of producing a toner particle is not particularly limited and wet methods such as the so-called emulsion polymerizing coagulation method, an emulsion polymerization method and a suspension polymerization method, and dry methods such as a pulverizing method can be employed, and the wet method which are superior in reducing a particle size for achieving high image quality and narrowing a particle size distribution and in flexibility for increasing sphericity of a particle, particularly the emulsion polymerizing coagulation method, is preferred.

The case where toners are produced employing the emulsion polymerizing coagulation method will be described in detail. Such a method of producing a toner includes the following steps.

(1) Preparation step of dispersion of resin fine particles (2) Preparation step of dispersion of coloring gent fine particles (3) Aggregation and fusion step of resin fine particles or the like (4) Step of aging (5) Step of cooling (6) Step of washing (7) Step of drying (8) Step of treating with external additive Each step will be described hereinafter.

(1) Preparation Step for Dispersion of Resin Fine Particles

This is a step of performing emulsion polymerization by putting a polymerizable monomer forming resin fine particles into a water-based medium to form resin fine particles having a size of about 100 nm. It is also possible to form resin fine particles containing wax therein. In this case, if the wax is dissolved or dispersed in the polymerizable monomer in advance and the resulting polymerizable monomer is polymerized in a water-based medium, the resin fine particles containing wax therein are formed.

(2) Preparation Step for Dispersion of Coloring Gent Fine Particles

It is a step where a coloring agent is dispersed in a water-based medium to prepare a coloring agent fine particle dispersion having a size of about 110 nm.

(3) Aggregation and Fusion Step of Resin Fine Particles

This is a step for aggregating resin fine particles and coloring agent particles in a water-based medium, and fusing these aggregated particles to prepare colored particles. In this step, to the water-based medium in which the resin fine particles and the coloring agent particles exist, an aggregating agent such as alkali metal salts typified by magnesium chloride and the like or alkaline earth metal salts is added, and then, the resulting mixture is heated to a temperature of a glass transition point of the resin fine particle or higher and a melting peak temperature (° C.) of the mixture or higher to allow the aggregation to proceed and to allow the resin fine particles to fuse with one another. When the aggregation proceeds and a particle size reaches a desired value, salts such as sodium chloride are added to stop the aggregation.

In the present specification, the term "aggregation" is used in a concept meaning that at least a plurality of resin fine particles merely adhere to one another. By the "aggregation", so-called heteroaggregation particles (group), in which constituent particles contact one another but a bond by melting of resin fine particles or the like is not formed, are formed. A group of particles formed by such "aggregation" is referred to as "aggregated particles". The term "fusion" is used in a concept meaning that a bond by melting of resin fine particles or the like is formed at least a part of the boundary between the respective constituent particles in the aggregated particles and aggregated particles becomes one particle as a unit of use or a unit of handling. A group of particles undergoing such "fusion" is referred to as "fused particles".

(4) Step of Aging

This is a step for aging the colored particles until a shape of the colored particle becomes a shape having a desired degree of roundness by heating the reaction system, followed by the above aggregation and fusion step.

(5) Step of Cooling

This is a step for cooling (quenching) the colored particle dispersion. As the conditions of cooling, a rate of cooling of 1 to 20° C./min is employed. A cooling method is not particularly limited, and a method in which a cooling medium is contacted with the outside of a reaction container to cool the colored particle dispersion, and a method in which cool water is directly put into the reaction system to cool the colored particle dispersion can be exemplified.

(6) Step of Washing

This step includes a step (solid-liquid separation) for separating the colored particles from the colored particle dispersion cooled to a predetermined temperature in the above-mentioned step, and a step for washing to remove adhering substances such as a surfactant and an aggregating agent from the colored particles formed into a wet cake-like aggregate, referred to as a toner cake, by solid-liquid separation.

In a washing treatment, water washing is carried out until the electric conductivity of a filtrate become, for example, about 10 μS/cm. Examples of a filtration method include a centrifugal separation method, a method of filtration under reduced pressure using a Nutsche funnel or the like, a filtration method using a filter press, and the filtration method is not particularly limited.

(7) Step of Drying

This is a step for drying the washed colored particles to obtain dried toner particles. Examples of a dryer used in this step include a spray dryer, a vacuum freeze dryer, a vacuum dryer and the like, and it is preferred to use a standing tray dryer, a moving tray dryer, a fluidized bed dryer, a rotary dryer, or an agitating dryer.

A water content of the dried toner particle is preferably 5% by weight or less, and more preferably 2% by weight or less. If dried toner particles are aggregated with one another through a weak attracting force between particles, the aggregated particles may be pulverized. As an pulverizing apparatus, mechanical pulverizing apparatuses such as a jet mill, a Henschel mixer, a coffee mill and a food processor can be used.

(8) Step of Treating with External Additive

This is a step for adding external additives including the composite oxide particles previously described to the dried toner particles to give a toner. Examples of an apparatus of mixing the external additives include mechanical mixing apparatuses such as a Henschel mixer and a coffee mill.

By undergoing the above-mentioned process steps, a toner can be produced.

The toner is preferably a toner having a median diameter (D50) on a volume basis of 3 or more and 8 μm or less, and such a toner belonging to a small size category is most suitable for reproducing high-definition dot images corresponding to digital technologies described later.

The median diameter (D50) on a volume basis can be measured and calculated, for example, by using an apparatus configured by connecting a computer system loaded with software for date processing "Software V3.51" to "Multisizer 3 (made by Beckman Coulter, INC.)".

A measuring procedure is as follows. After 0.02 g of a toner is applied to 20 ml of a surfactant solution (a surfactant solution prepared, for example, by diluting a detergent containing surfactant ingredients 10 fold with pure water for the purpose of dispersing the toner), ultrasonic dispersion is applied to the surfactant solution for 1 minute to prepare a toner dispersion. This toner dispersion is put in a beaker containing ISOTON II (made by Beckman Coulter, INC.) in a sample stand with a pipet until a measured concentration reaches 5 to 10% and a count of a measuring meter is set at 25000 to perform measurement. An aperture having an aperture diameter of 50 μm is used in Multisizer 3.

An acid value of the toner particle is not particularly limited, but it is preferably 5~30 KOH mg/g, and more preferably 7~25 KOH mg/g. Even a toner particle having a relatively high acid value can maintain electrostatic charge performance more stably without being affected by an environment of print preparation. That is, the toner particles having an acid value within the above range exhibit the stable property of build up of electrification and electrification stability even in an environment where a water content in the air tends to be adsorbed on the surface of the toner particle to cause leakage like an environment of high temperature and high humidity. Even in an environment where the toner tends to be excessively charged electrically as in an environment of low temperature and low humidity, leakage occurs by virtue of the existence of composite oxide particles even though a state in which the water content in the air is low and the leakage hardly occurs, and whereby excessive charging of the toner is prevented.

The acid value of the toner particle refers to a value of milligrams of potassium hydroxide required for neutralizing a polar group such as a carboxyl group contained in 1 g of resin particles or toner particles. The acid value of the toner particle is calculated as follows: a sample is dissolved in a benzene-ethanol mixed solution and titration is performed with a potassium hydroxide solution whose exact titer is known and then the acid value is calculated from the amount of potassium hydroxide required for neutralization. Specific examples of a method for measuring the acid value of a toner include a method according to JIS-0070-1992.

The acid value of a toner can be controlled, for example, by adjusting the composition ratio of an acid fraction having a carboxyl group such as an acrylic acid-based monomer or the like or the constituents in a polymerization reaction at the time of producing a toner in the case of a resin formed by an addition polymerization reaction. The acid value of a toner can be controlled by controlling a ratio between an acid component and an alcohol component at a stage of polymerization, for example, by introducing a polyfunctional acid such as trimellitic acid to suppress progress of crosslinking reaction, or by changing the conditions of polymerization, in the case of a resin formed by polycondensation reaction.

A binder resin, a coloring agent and wax, constituting a toner, will be described by way of specific examples.

As a binder resin, a polymer, which is formed by polymerizing a polymerizable monomer described below, referred to as a vinyl-based monomer, can be used. In a polymer constituting a resin capable of being used in the present invention, a polymer obtained by polymerizing at least one polymerizable monomer is used as a constituent component, and a polymer prepared by using these vinyl-based monomers singly or in combination is used.

Specific examples of the polymerizable monomer are described.

(1) Styrene or Styrene Derivatives

Styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and the like.

(2) Methacrylic Ester Derivatives

Methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like.

(3) Acrylic Ester Derivatives

Methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like.

(4) Olefins

Ethylene, propylene, isobutylene, and the like.

(5) Vinyl Esters

Vinyl propionate, vinyl acetate, vinyl benzoate, and the like.

(6) Vinyl Ethers

Vinyl methyl ether, vinyl ethyl ether, and the like.

(7) Vinyl Ketones

Vinyl methyl ketone, vinyl ethyl ketone, vinyl hexyl ketone, and the like.

(8) N-Vinyl Compounds

N-vinyl carbazole, N-vinyl indole, N-vinyl pyrrolidone, and the like.

(9) Others

Vinyl compounds such as vinyl naphthalene and vinyl pyridine; and acrylic or methacrylic derivatives such as acrylonitrile, methacrylonitrile and acrylamide.

The toner may be formed by appropriately using a polymerizable monomer having the polar group described above or a highly hydrophilic polymerizable monomer in addition to the above-mentioned polymerizable monomers.

It is also possible to prepare a binder resin having a crosslinking structure by using polyfunctional vinyls shown below. Specific examples thereof are shown below.

Divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

Examples of the coloring agent include publicly known coloring agents. Specific coloring agents are shown below.

As a black coloring agent, for example, carbon black such as furnace black, channel black, acetylene black, thermal black and lamp black, and magnetic powders such as magnetite and ferrite are used.

Examples of the coloring agent for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 150, C.I. pigment red 166, C.I. pigment red 177, C.I. pigment red 178, C.I. pigment red 184, C.I. pigment red 238 and C.I. pigment red 222.

Examples of the coloring agent for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 74, C.I. pigment red 93, C.I. pigment yellow 94, C.I. pigment yellow 138, C.I. pigment yellow 155 and C.I. pigment yellow 180.

Examples of the coloring agent for green or cyan include C.I. pigment blue 15, C.I. pigment blue 15:2, C.I. pigment blue 15:3, C.I. pigment blue 15:4, C.I. pigment blue 16, C.I. pigment blue 60, C.I. pigment blue 62, C.I. pigment blue 66, C.I. pigment green 7, and the like.

These coloring agents can also be used singly or in combination of two or more species selected as required. An addition amount of the coloring agent is preferably set at 1 to 30% by weight, preferably 2 to 20% by weight, with respect to the whole amount of the toner.

Examples of the wax include publicly known waxes as described below.

(1) Polyolefin-Based Wax

Polyethylene wax, polypropylene wax, and the like.

(2) Long Chain Hydrocarbon-Based Wax

Paraffin wax, Sasol Wax, and the like.

(3) Dialkyl Ketone-Based Wax

Distearyl ketone and the like.

(4) Ester-Based Wax

Carnauba wax, montan wax, trimethylolpropane tribehenate, pentaerythritol tetramyristate, pentaerythritol tetrastearate, pentaerythritol tetrabehenate, pentaerythritol diacetate-dibehenate, glycerintribehenate, 1,18-octadecanedioldistearate, tristearyl trimeritate, distearyl maleate, and the like.

(5) Amide-Based Wax

Ethylenediamine dibehenylamide, trimellitic acid tristearyl amide, and the like.

A melting point of the wax is usually 40 to 125° C., preferably 50 to 120° C., and more preferably 60 to 90° C. By using the wax having a melting point within the above range, heat resistance and preserving property of the toner is secured and a stable toner image can be formed without causing cold offset even when fixation is performed at a low temperature. The content of wax in the toner is preferably 1 to 30% by weight, and more preferably 5 to 20% by weight.

Inorganic fine particles or organic fine particles other than the composite oxide particles can be added to the toner as an external additive.

Kinds of the external additive which can be used in combination with the composite oxide particles are not particularly limited, and examples thereof include inorganic fine particles or organic fine particles, described blow, and further a lubricant.

As the inorganic fine particle, a publicly known fine particle can be used, and the fine particle having an average primary particle size of 4 to 800 nm is preferably used. Specifically, silica, alumina and the like can be preferably used. These inorganic fine particles may be hydrophobized as required.

Examples of the silica fine particle include commercial items R-805, R-976, R-974, R-972, R-812 and R-809 made by Nippon Aerosil Co., Ltd.; commercial items HVK-2150 and H-200 made by Hoechst Japan Limited; commercial items TS-720, TS-530, TS-610, H-5 and MS-5 made by Cabot Corporation.

Examples of the alumina fine particle include commercial items RFY-C and C604 made by Nippon Aerosil Co., Ltd.; and commercial items TTO-55 made by ISHIHARA SANGYO KAISHA, LTD.

As the organic fine particle, a spherical organic fine particle having an average primary particle size of about 10 to 2000 nm can be used. Specifically, homopolymers of styrene and methyl methacrylate, or copolymers thereof can be used.

In order to improve cleaning property or transfer property, a metal salt of higher fatty acid, referred to as a lubricant, can also be employed as an external additive. Specific examples of the metal salt of higher fatty acid include the following compounds: that is, salts of zinc, aluminum, copper, magnesium, calcium or the like of stearic acid; salts of zinc, manganese, iron, copper, magnesium or the like of oleic acid; salts of zinc, copper, magnesium, calcium or the like of palmitic acid; salts of zinc, calcium or the like of linolic acid; and salts of zinc, calcium or the like of recinoleic acid.

An amount of the external additive added to the toner, including the above composite oxide particles, is preferably 0.1 to 10.0% by weight with respect to the toner particles. Examples of methods of adding the external additive include methods of using of various publicly known mixing apparatuses such as a turbular mixer, a Henschel mixer, a Nauter mixer and a V-type mixer for addition.

As a carrier, for example, a conventionally publicly known magnetic material such as metal, for example, iron, ferrite and magnetite; or an alloy of these metals with metals, for example, aluminum and lead may be used as they are, or a carrier of a binder type formed by dispersing the magnetic material in a binder resin for a carrier may be used, or a carrier of a coat type formed by using the magnetic material as a core particle and coating the surface of the core particle with a resin layer may be used. The carrier of a coat type is preferred from the viewpoint of increasing electric resistance of the carrier.

The carrier of a coat type can be produced, for example, by mixing core particles and a coating resin with a high-speed mixer to form a resin layer on the surface of the core particle through an action of mechanical impact force.

The coating resin suitable for forming a coating layer of the carrier are polyolefin-based resins such as polyethylene, polypropylene, chlorinated polyethylene and chlorosulfonated polyethylene; polyacrylates such as polystyrene and polymethyl methacrylate; polyvinyl-based and polyvinylidene-based resins such as polyacrylonitrile, polyvinyl acetate, polyvinyl alcohol, polyvinyl butyral, polyvinyl chloride, polyvinyl carbazole, polyvinyl ether and polyvinyl ketone; copolymers such as a vinyl chloride-vinyl acetate copolymer and a styrene-acrylic acid copolymer; silicone resins including an organosiloxane bond or modified resins thereof (for example, resins modified with alkyd resins, polyester resins, epoxy resins, polyurethane, or the like); fluororesins such as polytetrachloroethylene, polyvinyl fluoride, polyvinylidene fluoride and polychlorotrifluoroethylene; polyamides; polyesters; polyurethanes; polycarbonates; amino resins such as urea-formaldehyde resin; and epoxy resins.

An average thickness h of the resin layer is preferably 50 to 4000 nm, more preferably 200 to 3000 nm from the viewpoint of achieving both durability and lower resistance of the carrier.

The carrier of a binder type can be produced by melting and kneading a binder resin for a carrier and a magnetic material, cooling the kneaded mixture, and pulverizing and classifying the kneaded mixture. The carrier of a binder type prepared by a polymerization method can also be suitably used.

As the binder resin for a carrier, a phenolic resin can also be used in addition to the above-mentioned coating resin.

A volume average particle size of the carrier is preferably 15 to 100 nm, more preferably 20 to 60 nm.

In the developer of Embodiment 1, a mixing ratio of the toner and the carrier is not particularly limited, and in general, a weight ratio (toner/carrier), depending on the particle sizes of the toner and the carrier, is preferably 3/97 to 10/90. The developer can be produced by adequately mixing the toner and the carrier added in such a ratio.

Embodiment 2

A developer of Embodiment 2 contains composite oxide particles in the form of (A2), that is, it is a two-component developer in which the composite oxide particles are added internally to toner particles. In the present embodiment, the contact between the toner particle to which the composite oxide particles are added internally and a carrier is secured and the excellent property of build up of electrification and the excellent charge stability of the toner are exhibited.

In the present specification, "being added internally to the toner particle" means that the composite oxide particles are added in the course of a production process of the toner particles and contained within the toner particle.

As an internally added state, it is preferred that the composite oxide particles exist in the vicinity of the surface of the toner particle.

The developer of Embodiment 2 is similar to the developer of Embodiment 1 described above except that the composite oxide particles are added internally to the toner particles instead of adding the composite oxide particles externally to the toner particles.

In the developer of Embodiment 2, particularly the toner particle is similar to the toner particle in the developer of Embodiment 1 except that the composite oxide particles are added in the aggregation and fusion step of resin fine particles to be aggregated and fused together with the resin fine particles and coloring agent particles. In Embodiment 2, the toner particle can also be produced by mixing the composite oxide particle with a binder resin and a coloring agent prior to melting and kneading in the so-called pulverizing method.

In the developer of Embodiment 2, a content of the composite oxide particle is not particularly limited as long as the content with respect to the whole developer is in the above-mentioned range, and in general, it is preferably 0.1 to 10.0% by weight, and particularly 0.5 to 5.0% by weight with respect to the whole toner.

Embodiment 3

A developer of Embodiment 3 contains composite oxide particles in the form of (A3), that is, it is a two-component developer in which the composite oxide particles are added internally to a carrier. In the present embodiment, the contact between the composite oxide particles which have been added internally to the carrier and exist in the vicinity of the surface of the carrier and the toner is secured, and the excellent property of build up of electrification and the excellent charge stability of the toner are exhibited.

In the present specification, "being added internally to the carrier" means that the composite oxide particles are added in the course of a production process of the carrier and contained in the carrier.

As an added state, it is preferred that the composite oxide particles exist in the vicinity of the surface of the carrier.

The developer of Embodiment 3 is similar to the developer of Embodiment 1 described above except that the composite oxide particles are added internally to the carrier instead of adding the composite oxide particles externally to the toner particles.

In Embodiment 3, a method of producing a carrier is not particularly limited as long as the composite oxide particle is contained in the carrier.

For example, the carrier of a coat type used in the developer of Embodiment 3 can be produced by following the same production method as in the carrier of a coat type of the developer of Embodiment 1 except that core particles, a coating resin and the composite oxide particles are mixed with a high-speed mixer to form a resin layer on the surface of the core particle through the actions of a mechanical impact force and heat generation and simultaneously the composite oxide particles are contained in the resin layer.

For example, the carrier of a binder type used in the developer of Embodiment 3 can be produced by following the same production method as in the carrier of a binder type of the developer of Embodiment 1 except for melting and kneading a binder resin for a carrier, a magnetic material and the composite oxide particles.

In the developer of Embodiment 3, a content of the composite oxide particle is not particularly limited as long as the content with respect to the whole developer is in the above-mentioned range, and in general, it is preferably 0.1 to 10.0% by weight, and particularly 0.5 to 5% by weight with respect to the whole carrier.

Embodiment 4

A developer of Embodiment 4 contains composite oxide particles in the form of (A4), that is, it is a two-component developer in which the composite oxide particles are added externally to a carrier. In the present embodiment, the contact between toner particles and the composite oxide particles added externally to the carrier is secured and by adjusting the surface resistance of the carrier, the excellent property of build up of electrification, the adjustment of charging level and the charge stability of the toner are exhibited with more reliability.

In the present specification, "being added externally to the carrier" means that being added to and mixed with the carrier obtained once.

The developer of Embodiment 4 is similar to the developer of Embodiment 1 described above except that the composite oxide particles are added externally to the carrier instead of adding the composite oxide particles externally to the toner particles.

In the developer of Embodiment 4, particularly the carrier is similar to the carrier in the developer of Embodiment 1 except that the composite oxide particles mainly adhere to the surface of the carrier. This makes it possible to secure the contact between the toner particles and the composite oxide particles added externally to the carrier, and by adjusting the surface resistance of the carrier, the excellent property of build up of electrification, the adjustment of charging level and charge stability of the toner are exhibited with more reliability.

In the developer of Embodiment 4, a content of the composite oxide particles is not particularly limited as long as the content with respect to the whole developer is in the above-mentioned range, and in general, it is preferably 0.0001 to 1% by weight, and particularly 0.0005 to 0.1% by weight with respect to the carrier.

Embodiment 5

A developer of Embodiment 5 contains composite oxide particles in the form of (A5), that is, it is a two-component developer in which the composite oxide particles are added to a developer as a third component. In the present embodiment, by adding the composite oxide particles as a third component to the developer to interpose the third component between a toner and a carrier, the excellent property of build up of electrification and the excellent charge stability of the toner are exhibited.

In the present specification, "being added to the developer as a third component" means being added as the third component in the step in which the toner and the carrier, respectively obtained once, are mixed to prepare a developer. Therefore, in the developer of Embodiment 5, by interposing the composite oxide particles between the carrier and the toner, improvements in the property of build up of electrification and the charge stability of the toner are exhibited.

The developer of Embodiment 5 is similar to the developer of Embodiment 1 described above except that the composite oxide particles are added externally to the toner and the carrier instead of adding the composite oxide particles to the toner particles as an external additive.

The developer of Embodiment 5 can be produced by following the same production method as in the developer of Embodiment 1 except that the composite oxide particles are added and mixed in addition to the toner and the carrier in the step of mixing the toner and the carrier.

In the developer of Embodiment 5, a content of the composite oxide particles is not particularly limited as long as the content with respect to the whole developer is in the above-mentioned range, and in general, it is preferably 0.001 to 5% by weight, and particularly 0.01 to 3% by weight with respect to the whole developer.

Embodiment 6

A developer of Embodiment 6 contains composite oxide particles in the form of (B1), that is, it is a mono-component developer in which the composite oxide particles are added externally to toner particles. In the present embodiment, as with Embodiment 1, the contact between the toner particles and the composite oxide particles added externally to the toner particle is secured, and the excellent property of build up of electrification and the excellent charge stability of the toner are exhibited with more reliability.

The developer of Embodiment 6 is similar to the developer of Embodiment 1 described above except for not containing a carrier.

In the developer of Embodiment 6, a content of the composite oxide particles is not particularly limited as long as the content with respect to the whole developer is in the above-mentioned range, and in general, it is preferably 0.1 to 10% by weight, and particularly 0.3 to 5% by weight with respect to the toner particles. More preferably, the content is 0.5 to 2% by weight.

Embodiment 7

A developer of Embodiment 7 contains composite oxide particles in the form of (B2), that is, it is a mono-component developer in which the composite oxide particles are added internally to toner particles. In the present embodiment, the contact between the composite oxide particles which has been added internally to the toner particles and are exposed to the surface of the toner particle, and the adjacent toner is secured, as in Embodiment 2, and the excellent property of build up of electrification and the excellent charge stability of the toner are exhibited.

The developer of Embodiment 7 is similar to the developer of Embodiment 2 described above except for not containing a carrier.

In the developer of Embodiment 7, a content of the composite oxide particles is not particularly limited as long as the content with respect to the whole developer is in the above-mentioned range, and in general, it is preferably 0.1 to 10% by weight, particularly 0.5 to 5% by weight with respect to the whole toner.

When the developer of the present invention is a two-component developer, the two-component developer is loaded on a publicly known image-forming apparatus employing so-called two-component developing system to be used.

When the developer of the present invention is a mono-component developer, the mono-component developer is loaded on a publicly known image-forming apparatus employing so-called mono-component developing system to be used.

These image-forming apparatuses may be those for forming a monochrome image, or may be those for forming a full-color image

EXAMPLES

Embodiments of the present invention will be specifically described by way of examples hereinafter, but the present invention is not limited thereto.

Production of Inorganic Particle 1

A pH of a metatitanic acid dispersion prepared by a sulfuric acid method was adjusted to 9.0 by using a 4.0 mol/liter aqueous solution of sodium hydroxide to allow the dispersion to be desulfurized, and then a 6.0 mol/liter aqueous solution of hydrochloric acid was added to adjust pH of the resulting mixture to 5.5 to perform neutralization. Thereafter, the metatitanic acid dispersion was separated by filtration and the resulting solid fraction was washed with water to prepare a cake of metatitanic acid. Water was added to the cake to prepare a dispersion having a concentration corresponding to 1.25 mol/liter in terms of titanium oxide $TiO_2$, and a pH of the dispersion was adjusted to 1.2 by using a 6.0 mol/liter aqueous solution of hydrochloric acid. Then, the temperature of the dispersion was adjusted to 35° C. and the dispersion was stirred at this temperature for 1 hour to deflocculate the metatitanic acid dispersion.

Metatitanic acid equivalent to 0.156 mol in terms of titanium oxide $TiO_2$ was taken from the deflocculated metatitanic acid dispersion and put into a reaction container, and subsequently an aqueous solution of calcium carbonate $CaCO_3$ and an aqueous solution of niobium oxide were put into the reaction container. Thereafter, the reaction system was adjusted in such a manner that the concentration of titanium oxide is 0.156 mol/liter. Calcium carbonate $CaCO_3$ was added so as to have a molar ratio to titanium oxide of 1.15 ($CaCO_3/TiO_2$=1.15/1.00) and niobium oxide was added so as to have a molar ratio to titanium oxide of 0.001 ($Nb_2O_5/TiO_2$=0.001/1.00).

A nitrogen gas was supplied to the inside of the reaction container to leave the reaction container as it is for 20 minutes, and the inside atmosphere of the reaction container was replaced with a nitrogen gas. Thereafter, a mixture solution including metatitanic acid, calcium carbonate and niobium oxide was heated to 90° C. Subsequently, an aqueous solution of sodium hydroxide was added over 24 hours until a pH reached 8.0, and then the resulting mixture was stirred at 90° C. for 1 hour to complete the reaction.

After the completion of the reaction, the inside of the reaction container was cooled to 40° C. and the supernatant was removed under a nitrogen atmosphere, and then 2500 parts by weight of pure water was put into the reaction container and decantation was performed twice. After the decantation, the reaction system was filtered using a Nutsche funnel to form a cake and the formed cake was heated to 100° C. to be dried for 8 hours in the air.

The resulting dried product of calcium titanate was put in an aluminum crucible, and dehydrated and calcined at 930° C. After calcination, the resultant calcium titanate was put into water, and subjected to a wet grinding treatment using a sand grinder to give a dispersion. To this, 6.0 mol/liter aqueous solution of hydrochloric acid was added to adjust a pH to 2.0 and to remove excessive calcium carbonate. After the removal treatment, a wet hydrophobizing treatment was applied to the calcium titanate using a silicone oil emulsion (dimethylpolysiloxane-based emulsion) "SM 7036EX (made by Dow Corning Toray Silicone Co., Ltd.)". The hydrophobizing treatment was a treatment in which 0.7 parts by weight of the silicone oil emulsion was added to 100 parts by weight of solid content of calcium titanate and the resulting mixture was stirred for 30 minutes.

After the wet hydrophobizing treatment, a 4.0 mol/liter aqueous solution of sodium hydroxide was added to adjust its pH to 6.5 for neutralization. Thereafter, the mixture was separated by filtration, and the resulting solid fraction was washed and dried at 150° C. The solid fraction was pulverized for 60 minutes with a mechanical pulverizing apparatus to give "Inorganic particle 1", which is calcium titanate containing niobium atoms.

The content of niobium atom in the prepared "Inorganic particle 1" was measured by an IPC analysis method to be 0.010% by weight. A particle size on a volume basis, a standard deviation (SD value) of particle size and a BET specific surface area of the prepared "Inorganic particle 1" were measured by the above-mentioned methods. The particle size on a volume basis was 198 nm, the standard deviation (SD value) of particle size was 108 nm, and the BET specific surface area was 15.4 $m^2/g$.

Production of Inorganic Particles 2 to 20

Inorganic particles were produced by following the same production method as in the production method of Inorganic particle 1 except that a second metal atom described in Table 1 was used and a predetermined addition amount of a predetermined addition material was used in order to use a third metal atom described in Table 1.

As the second metal atom, strontium carbonate was used in the case of strontium (Sr), magnesium carbonate was used in the case of magnesium (Mg), and barium carbonate was used in the case of barium (Ba).

TABLE 1

| Inorganic particle No. | Second metal atom | Third metal a: Element | Third metal a: Added material | Third metal a: Added amount (molar ratio) | Third metal a: Content (% by weight) | Properties: Number average particle size (nm) | Properties: Standard deviation of particle size (nm) | Properties: BET specific surface area ($m^2/g$) |
|---|---|---|---|---|---|---|---|---|
| 1 | Ca | Nb (niobium) | niobium oxide | 0.001 | 0.01 | 198 | 108 | 15.4 |
| 2 | Ca | Nb (niobium) | niobium oxide | 0.003 | 0.03 | 205 | 112 | 15.2 |
| 3 | Ca | Nb (niobium) | niobium oxide | 0.03 | 0.27 | 208 | 110 | 15.1 |
| 4 | Ca | V (vanadium) | vanadium oxide | 0.001 | 0.01 | 195 | 102 | 15.5 |
| 5 | Ca | V (vanadium) | vanadium oxide | 0.01 | 0.1 | 205 | 123 | 15.6 |
| 6 | Ca | V (vanadium) | vanadium oxide | 0.03 | 0.28 | 210 | 128 | 15.1 |
| 7 | Ca | Ta (tantalum) | tantalum oxide | 0.001 | 0.01 | 198 | 141 | 15.3 |
| 8 | Ca | Ta (tantalum) | tantalum oxide | 0.01 | 0.1 | 201 | 146 | 15.5 |
| 9 | Ca | Ta (tantalum) | tantalum oxide | 0.035 | 0.345 | 208 | 153 | 15.2 |
| 10 | Sr | Nb (niobium) | niobium oxide | 0.01 | 0.1 | 225 | 168 | 9.7 |
| 11 | Mg | Nb (niobium) | niobium oxide | 0.01 | 0.1 | 211 | 127 | 15.9 |
| 12 | Ba | Nb (niobium) | niobium oxide | 0.01 | 0.1 | 195 | 105 | 16.3 |
| 13 | Ca | Nb (niobium) | niobium oxide | 0.01 | 0.09 | 35 | 98 | 26.2 |
| 14 | Ca | Nb (niobium) | niobium oxide | 0.01 | 0.1 | 51 | 101 | 24.8 |
| 15 | Ca | Nb (niobium) | niobium oxide | 0.01 | 0.1 | 1980 | 143 | 5.2 |
| 16 | Ca | Nb (niobium) | niobium oxide | 0.01 | 0.1 | 2800 | 241 | 4.5 |
| 17 | Ca | none | none | 0 | 0 | 205 | 128 | 14.7 |
| 18 | Ca | Nb (niobium) | niobium oxide | 0.0009 | 0.008 | 210 | 131 | 14.6 |
| 19 | Ca | Nb (niobium) | niobium oxide | 0.042 | 0.4 | 213 | 113 | 14.8 |
| 20 | Sr | none | none | 0 | 0 | 218 | 263 | 8.1 |

Production of Toner Particle A (1) Preparation of "Resin Particle 1H"

In a reaction container equipped with a stirring apparatus, a temperature sensor, a condenser and a nitrogen inlet, 7.08 parts by weight of sodium lauryl sulfate as an anionic surfactant was dissolved in 3010 parts by weight of ion-exchanged water to prepare a surfactant solution (water-based medium). Then, an internal temperature of the reaction container was raised to 80° C. while stirring the surfactant solution at a rotation speed of 230 rpm under a nitrogen stream.

Into the surfactant solution, a polymerization initiator solution prepared by dissolving 9.2 parts by weight of potassium persulfate (KPS), a polymerization initiator, in 200 parts by weight of ion-exchanged water was put, and an internal temperature of the reaction container was raised to 75° C. Thereafter, "Mixture solution 1A" including the following compounds was dropped over one hour:

| | |
|---|---|
| styrene | 69.4 parts by weight |
| n-butyl acrylate | 28.3 parts by weight |
| methacrylic acid | 2.3 parts by weight. |

The resulting mixture was stirred at a temperature of 75° C. for 2 hours for polymerization to prepare "Resin particle dispersion 1H".

(2) Preparation of "Resin Particle 1HM"

Into a flask equipped with a stirring apparatus, the following compounds were charged:

| | |
|---|---|
| styrene | 97.1 parts by weight |
| n-butyl acrylate | 39.7 parts by weight |
| methacrylic acid | 3.22 parts by weight |
| n-octyl-3-mercaptopropionate | 5.6 parts by weight. |

To this, 98.0 parts by weight of pentaerythritol tetrabehenate was further added, and the resulting mixture was heated to 90° C. to dissolve a compound A to prepare "Mixture solution 1B" including the above compounds.

On the other hand, in a reaction container equipped with a stirring apparatus, a temperature sensor, a condenser and a nitrogen inlet, 1.6 parts by weight of sodium lauryl sulfate was dissolved in 2700 parts by weight of ion-exchanged water to prepare a surfactant solution, and the surfactant solution was heated to 98° C. To the surfactant solution, 28 parts by weight in terms of a solid content of "Resin particle dispersion 1H" described above was added, and then the mixture solution 1B was put thereinto. The resulting mixture was mixed and dispersed for 8 hours by a mechanical dispersing apparatus "CLEARMIX (made by M Technique Co., Ltd.)" to prepare a dispersion (emulsion).

Then, to the prepared dispersion (emulsion), an initiator solution prepared by dissolving 5.1 parts by weight of potassium persulfate (KPS) in 240 parts by weight of ion-exchanged water and 750 parts by weight of ion-exchanged water were added. The resulting system was stirred at a temperature of 98° C. for 12 hours to carry out polymerization. In this manner, a dispersion of "Resin particle 1HM" having a composite structure, in which the surface of "Resin particle 1H" was coated with a resin, was prepared.

(3) Preparation of "Resin Particle 1HML"

To the dispersion of "Resin particle 1HML", a initiator solution prepared by dissolving 7.4 parts by weight of potassium persulfate (KPS) in 200 parts by weight of ion-exchanged water was added, and a temperature of the resulting mixture was adjusted to 80° C. Thereafter, "Mixture solution 1C" including the following compounds was dropped over one hour. That is,

| | |
|---|---|
| styrene | 277 parts by weight |
| n-butyl acrylate | 113 parts by weight |
| methacrylic acid | 9.21 parts by weight |
| n-octyl-3-mercaptopropionate | 10.4 parts by weight |

After dropping, the resulting mixture was heated and stirred at the temperature described above over 2 hours to carry out polymerization, and then the reaction system was cooled to 28° C. to prepare a dispersion of "Resin particle 1HML" having a composite structure in which the surface of "Resin particle 1HM" was coated with a resin. A particle size of the prepared resin particles was about 150 nm.

(4) Preparation of "Coloring Agent Dispersion 1Bk"

Sodium lauryl sulfate (90 parts by weight) as an anionic surfactant was put into 1600 parts by weight of ion-exchanged water and the resulting mixture was stirred to prepare a surfactant solution. The following carbon black as a coloring agent was gradually added to the surfactant solution while stirring the surfactant solution. That is,

| | |
|---|---|
| "Regal 330R (made by Cabot Corporation)" | 400 parts by weight |

After adding the carbon black, the resulting mixture was subjected to a dispersing treatment until a particle size of the carbon black became 200 nm using a mechanical dispersing apparatus "CLEARMIX (made by M Technique Co., Ltd.)" to prepare "Coloring agent dispersion 1".

(5) Preparation of "Toner Particle A" (Aggregation and Fusion)

Into a reaction container equipped with a stirring apparatus, a temperature sensor, a condenser, a nitrogen inlet and a stirring apparatus, the following substances were put, and then an internal temperature of the reaction container was adjusted to 30° C., and a 5 mol/liter aqueous solution of sodium hydroxide was further added to adjust a pH of the resulting mixture to 10.6. That is,

| | |
|---|---|
| "Resin Particle Dispersion 1HML" (in terms of solid content) | 200 parts by weight |
| Ion-exchanged water | 3000 parts by weight |
| "Coloring agent dispersion 1" (in terms of solid content basis) | 71 parts by weight |

After the above adjustment, an aqueous solution prepared by dissolving 52.6 parts by weight of magnesium chloride hexahydrate in 72 parts by weight of ion-exchanged water was added over 10 minutes while stirring the reaction system at a temperature of 30° C., and after the addition, the reaction system was left standing for 3 minutes.

Thereafter, heating of the reaction system was initiated and a temperature of the reaction system was raised to 75° C. over 60 minutes, and aggregation of the above-mentioned particles was initiated. Here, the aggregation was continued while measuring particle sizes of the aggregated particles using "Multisizer 3 (made by Beckman Coulter, INC.)".

When the median diameter on a volume basis of the aggregated particles reached 6.5 μm, an aqueous solution prepared by dissolving 115 parts by weight of sodium chloride in 700 parts by weight of ion-exchanged water was added to stop the growth of the particle. As an aging treatment, a solution temperature was raised to 90° C. and the mixture was stirred over 6 hours under heating to continue the fusion of the particles meanwhile. Thereafter, the reaction system was cooled to 30° C., and hydrochloric acid was added to adjust a pH to 2.0, and then stirring was stopped.

The colored particles prepared through aggregation and fusion, as described above, were separated from liquid, repeatedly washed with ion-exchanged water of 45° C. and then was dried with warm air of 40° C. to prepare "Toner particle A". An acid value of "Toner particle A" was measured by a method according to JTS 0070 (1992) to be a value of 15.

Production of Toner Particle B (1) Preparation of "Resin Particle 2H"

"Resin particle dispersion 2H" was prepared by following the same procedure as in the production step of "Resin particle 1H" described above except for using "Mixture solution 2A" including the following compounds in place of "Mixture solution 1A":

| | |
|---|---|
| styrene | 70.3 parts by mass |
| n-butyl acrylate | 28.7 parts by mass |
| methacrylic acid | 1.0 part by mass. |

(2) Preparation of "Resin Particle 2HM" (Second Stage Polymerization)

"Resin particle dispersion 2HM" was prepared by following the same procedure as in the production step of "Resin particle 1HM" described above except for using "Mixture solution 2B" including the following compounds in place of "Mixture solution 1B":

| | |
|---|---|
| styrene | 98.3 parts by mass |
| n-butyl acrylate | 40.2 parts by mass |
| methacrylic acid | 1.51 parts by mass |
| n-octyl-3-mercaptopropionate | 5.6 parts by mass |
| pentaerythritol tetrabehenate | 98 parts by mass. |

(3) Preparation of "Resin Particle 2HML"

"Resin particle dispersion 2HML" was prepared by following the same procedure as in the production step of "Resin particle 1HML" described above except for using "Mixture solution 2C" including the following compounds in place of "Mixture solution 10":

| | |
|---|---|
| styrene | 283 parts by mass |
| n-butyl acrylate | 115 parts by mass |
| methacrylic acid | 4.3 parts by mass |
| n-octyl-3-mercaptopropionate | 10.4 parts by mass. |

(4) Preparation of "Toner Particle B"

"Toner particle B" having an acid value of 7 was prepared by following the same procedure as in the preparation of "Toner particle A" described above except for replacing "Resin particle dispersion 1HML" with "Resin particle dispersion 2HML" in the preparation of "Toner particle A" described above.

Production of Toner Particle C (1) Preparation of "Resin Particle 3H"

"Resin particle dispersion 3H" was prepared by following the same procedure as in the production step of "Resin particle 1H" described above except for using "Mixture solution 3A" including the following compounds in place of "Mixture solution 1A":

| | |
|---|---|
| styrene | 74.5 parts by mass |
| n-butyl acrylate | 21.6 parts by mass |
| acrylic acid | 1.93 parts by mass |

(2) Preparation of "Resin Particle 3HM"

"Resin particle dispersion 3HM" was prepared by following the same procedure as in the production step of "Resin particle 1HM" described above except for using "Mixture solution 3B" including the following compounds in place of "Mixture solution 1B":

| | |
|---|---|
| styrene | 104 parts by mass |
| n-butyl acrylate | 30.2 parts by mass |
| acrylic acid | 2.7 parts by mass |
| n-octyl-3-mercaptopropionate | 5.6 parts by mass |
| pentaerythritol tetrabehenate | 98 parts by mass. |

(3) Preparation of "Resin Particle 3HML"

"Resin particle dispersion 3HML" was prepared by following the same procedure as in the production step of "Resin particle 1HML" described above except for using "Mixture solution 3C" including the following compounds in place of "Mixture solution 10":

| | |
|---|---|
| styrene | 306 parts by mass |
| n-butyl acrylate | 88.5 parts by mass |
| acrylic acid | 17.4 parts by mass |
| n-octyl-3-mercaptopropionate | 10.4 parts by mass. |

(4) Preparation of "Toner Particle C"

"Toner particle C" having an acid value of 25 was prepared by following the same procedure as in the preparation of "Toner particle A" described above except for replacing "Resin particle dispersion 1HML" with "Resin particle dispersion 3HML" in the preparation of "Toner particle A" described above.

Production of Toner Particle D (1) Preparation of "Resin Particle 4H"

"Resin particle dispersion 4H" was prepared by following the same procedure as in the production step of "Resin particle 1H" described above except for using "Mixture solution 4A" including the following compounds in place of "Mixture solution 1A":

| | |
|---|---|
| styrene | 70.7 parts by mass |
| n-butyl acrylate | 28.9 parts by mass |
| acrylic acid | 0.386 parts by mass |

(2) Preparation of "Resin Particle 4HM"

"Resin particle dispersion 4HM" was prepared by following the same procedure as in the production step of "Resin particle 1HM" described above except for using "Mixture solution 4B" including the following compounds in place of "Mixture solution 1B":

| | |
|---|---|
| styrene | 99 parts by mass |
| n-butyl acrylate | 40.4 parts by mass |
| acrylic acid | 0.54 parts by mass |
| n-octyl-3-mercaptopropionate | 5.6 parts by mass |
| Pentaerythritol tetrabehenate | 98 parts by mass. |

(3) Preparation of "Resin Particle 4HML"

"Resin particle dispersion 4HML" was prepared by following the same procedure as in the production step of "Resin particle 1HML" described above except for using "Mixture solution 4C" including the following compounds in place of "Mixture solution 1C":

| | |
|---|---|
| styrene | 281 parts by mass |
| n-butyl acrylate | 114.8 parts by mass |

-continued

| | |
|---|---|
| acrylic acid | 1.54 parts by mass |
| n-octyl-3-mercaptopropionate | 10.4 parts by mass |

(4) Preparation of "Toner Particle D"

"Toner particle D" having an acid value of 3 was prepared by following the same procedure as in the preparation of "Toner particle A" described above except for replacing "Resin particle dispersion 1HML" with "Resin particle dispersion 4HML" in the preparation of "Toner particle A" described above.

Production of Toner Particle E (1) Preparation of "Resin Particle 5H"

"Resin particle dispersion 5H" was prepared by following the same procedure as in the production step of "Resin particle 1H" described above except for using "Mixture solution 5A" including the following compounds in place of "Mixture solution 1A":

| | |
|---|---|
| styrene | 67.8 parts by mass |
| n-butyl acrylate | 27.7 parts by mass |
| methacrylic acid | 4.5 part by mass. |

(2) Preparation of "Resin Particle 5HM"

"Resin particle dispersion 5HM" was prepared by following the same procedure as in the production step of "Resin particle 1HM" described above except for using "Mixture solution 5B" including the following compounds in place of "Mixture solution 1B":

| | |
|---|---|
| styrene | 94.1 parts by mass |
| n-butyl acrylate | 38.4 parts by mass |
| methacrylic acid | 7.53 parts by mass |
| n-octyl-3-mercaptopropionate | 5.6 parts by mass |
| pentaerythritol tetrabehenate | 98 parts by mass. |

(3) Preparation of "Resin Particle 5HML"

"Resin particle dispersion 5HML" was prepared by following the same procedure as in the production step of "Resin particle 1HML" described above except for using "Mixture solution 5C" including the following compounds in place of "Mixture solution 10":

| | |
|---|---|
| styrene | 269 parts by mass |
| n-butyl acrylate | 110 parts by mass |
| methacrylic acid | 21.5 parts by mass |
| n-octyl-3-mercaptopropionate | 10.4 parts by mass. |

(4) Preparation of "Toner Particle E"

"Toner particle E" having an acid value of 35 was prepared by following the same procedure as in the preparation of "Toner particle A" described above except for replacing "Resin particle dispersion 1HML" with "Resin particle dispersion 5HML" in the preparation of "Toner particle A" described above.

Production of Toner Particle F

Toner particle F was produced by following the same procedure as in the preparation of Toner particle A except for putying also 6 parts by weight of an inorganic particle dispersion described below when putting Resin particle dispersion 1HML, the ion-exchanged water and the coloring agent dispersion 1 into the reaction container. An acid value of "Toner particle F" was 15 KOH mg/g.

The inorganic particle dispersion was prepared by the following method.

Sodium lauryl sulfate (90 parts by weight) as an anionic surfactant was put into 1600 parts by weight of ion-exchanged water and the resulting mixture was stirred to prepare a surfactant solution. Inorganic particle 2 (1600 parts by weight) was gradually added while stirring the surfactant solution. Thereafter, the resulting mixture was subjected to a dispersing treatment using a mechanical dispersing apparatus "CLEARMIX (made by M Technique Co., Ltd.)" to prepare "Inorganic particle dispersion".

Production of Toner 1

The following substances were added to Toner particle A as external additives.

| | |
|---|---|
| "Inorganic particle 1" | 2.0% by weight |
| Hydrophobic silica (particle size 17 nm, product treated with hexamethyldisilazane) | 1.0% by weight |
| Hydrophobic silica (particle size 21 nm, product treated with hexamethyldisilazane) | 1.0% by weight |

The treatment of adding these external additives was performed at 30° C. under the conditions of a stirring blade circumferential velocity of 35 m/sec and a treating time of 20 minutes using a Henschel mixer "FM10B (made by Mitsui Miike Machinery Co., Ltd.)", and coarse particles were removed with a sieve with an opening of 90 μm to produce "Toner 1".

Production of Toners 2 to 24

Toners were produced by following the same production method as in Toner 1 except for using a toner particle and an inorganic particle described in Table 2.

Production of Toner 25

A toner was produced by following the same production method as in Toner 1 except that Toner particle F was used and an external additive other than Inorganic particle 1 was added to the toner particle.

Production of Toner 26

A toner was produced by following the same production method as in Toner 1 except for adding an external additive other than Inorganic particle 1 to the toner particle.

Production of Toner 27

The following substances were added to Toner particle A as external additives.

| | |
|---|---|
| "Inorganic particle 17" | 2.0% by weight |
| "Niobium oxide particle" (particle size 200 nm, specific surface area 8 $m^2/g$) | 1.0% by weight |
| Hydrophobic silica (particle size 17 nm, product treated with hexamethyldisilazane) | 1.0% by weight |
| Hydrophobic silica (particle size 21 nm, product treated with hexamethyldisilazane) | 1.0% by weight |

The treatment of adding these external additives was performed at 30° C. under the conditions of a stirring blade circumferential velocity of 35 m/sec and a treating time of 20 minutes using a Henschel mixer "FM10B (made by Mitsui Miike Machinery Co., Ltd.)", and coarse particles were removed with a sieve with an opening of 90 μm to produce a toner.

TABLE 2

| Toner number | Toner particle | Inorganic particle No. | Inorganic particle Method of addition |
|---|---|---|---|
| 1 | A | 1 | as an external additive of toner |
| 2 | A | 2 | as an external additive of toner |
| 3 | A | 3 | as an external additive of toner |
| 4 | A | 4 | as an external additive of toner |
| 5 | A | 5 | as an external additive of toner |
| 6 | A | 6 | as an external additive of toner |
| 7 | A | 7 | as an external additive of toner |
| 8 | A | 8 | as an external additive of toner |
| 9 | A | 9 | as an external additive of toner |
| 10 | A | 10 | as an external additive of toner |
| 11 | A | 11 | as an external additive of toner |
| 12 | A | 12 | as an external additive of toner |
| 13 | A | 13 | as an external additive of toner |
| 14 | A | 14 | as an external additive of toner |
| 15 | A | 15 | as an external additive of toner |
| 16 | A | 16 | as an external additive of toner |
| 17 | A | 17 | as an external additive of toner |
| 18 | A | 18 | as an external additive of toner |
| 19 | A | 19 | as an external additive of toner |
| 20 | A | 20 | as an external additive of toner |
| 21 | B | 2 | as an external additive of toner |
| 22 | C | 2 | as an external additive of toner |
| 23 | D | 2 | as an external additive of toner |
| 24 | E | 2 | as an external additive of toner |
| 25 | F | 2 | as an internal additive of toner |
| 26 | A | — | non additive |
| 27* | A | 17 | as an external additive of toner |

*Niobium oxide was also added as an external additive.

Production of Carrier 1

Mn—Mg ferrite particles having a volume average diameter of 60 μm and saturated magnetization of $10.7\times10^{-5}$ Wb·m/kg were prepared. One hundred parts by weight of the Mn—Mg ferrite particles and 3.8 parts by weight of resin particles of styrene/methylmethacrylate copolymer (ratio of copolymerization 2:8) were put into a high-speed mixer equipped with stirring blades and the resulting mixture was stirred and mixed at 120° C. for 60 minutes to form resin layers on the surface of the ferrite particles through an action of a mechanical impact force, so that Carrier 1 coated with resin layer was obtained. A thickness of the resin layer of Carrier 1 was 2500 nm. A volume average particle size of Carrier 1 was 65 μm.

Production of Carrier 2

Mn—Mg ferrite particles having a volume average diameter of 60 μm and saturated magnetization of $10.7\times10^{-5}$ Wb·m/kg were prepared. One hundred parts by weight of the Mn—Mg ferrite particles, 3.8 parts by weight of resin particles of styrene/methylmethacrylate copolymer (ratio of copolymerization 2:8), and 5 parts by weight of Inorganic particle 2 were put into a high-speed mixer equipped with stirring blades and the resulting mixture was stirred and mixed at 120° C. for 60 minutes to form resin layers on the surface of the ferrite particles through an action of a mechanical impact force, and whereby Carrier 2, in which the resin layer contains Inorganic particle 2, was obtained. A thickness of the resin layer of Carrier 2 was 2540 nm. A volume average particle size of Carrier 2 was 65 μm.

Production of Developer 1

Carrier 1 (100 parts by weight) and 6 parts by weight of Toner 1 were mixed with a V-shaped mixer to produce Developer 1.

Production of Developers 2 to 26 and Developer 28

Developers were produced by following the same production method as in the developer 1 except for using a toner and a carrier respectively described in Table 3 in combination.

Production of Developer 27

Carrier 1 (100 parts by weight), 6 parts by weight of Toner 26, and 1 part by weight of Inorganic particle 2 were mixed with a V-shaped mixer to produce a developer.

TABLE 3

| Developer | | | Inorganic particle | |
|---|---|---|---|---|
| number | Toner | Carrier | No. | Method of addition |
| 1 | 1 | 1 | 1 | as an external additive of toner |
| 2 | 2 | 1 | 2 | as an external additive of toner |
| 3 | 3 | 1 | 3 | as an external additive of toner |
| 4 | 4 | 1 | 4 | as an external additive of toner |
| 5 | 5 | 1 | 5 | as an external additive of toner |
| 6 | 6 | 1 | 6 | as an external additive of toner |
| 7 | 7 | 1 | 7 | as an external additive of toner |
| 8 | 8 | 1 | 8 | as an external additive of toner |
| 9 | 9 | 1 | 9 | as an external additive of toner |
| 10 | 10 | 1 | 10 | as an external additive of toner |
| 11 | 11 | 1 | 11 | as an external additive of toner |
| 12 | 12 | 1 | 12 | as an external additive of toner |
| 13 | 13 | 1 | 13 | as an external additive of toner |
| 14 | 14 | 1 | 14 | as an external additive of toner |
| 15 | 15 | 1 | 15 | as an external additive of toner |
| 16 | 16 | 1 | 16 | as an external additive of toner |
| 17 | 17 | 1 | 17 | as an external additive of toner |
| 18 | 18 | 1 | 18 | as an external additive of toner |
| 19 | 19 | 1 | 19 | as an external additive of toner |
| 20 | 20 | 1 | 20 | as an external additive of toner |
| 21 | 21 | 1 | 2 | as an external additive of toner |
| 22 | 22 | 1 | 2 | as an external additive of toner |
| 23 | 23 | 1 | 2 | as an external additive of toner |
| 24 | 24 | 1 | 2 | as an external additive of toner |
| 25 | 25 | 1 | 2 | as an internal additive of toner |
| 26 | 26 | 2 | 2 | in a coating layer of a carrier |
| 27 | 26 | 1 | 2 | during preparing a developer |
| 28 | 27* | 1 | 17 | as an external additive of toner |

*Niobium oxide was also added as an external additive

Experiment Example 1

Two-Component Developer Example/Comparative Example

Developer described in Table 4 were loaded to an image-forming apparatus (bizhub Pro C450; made by Konica Minolta Holdings, Inc.) of a two component type and the image-forming apparatus was left standing for 24 hours in an environment of high temperature and high humidity (30° C., 80% RH), and then 3000 sheets of continuous prints were performed in this environment and image quality was evaluated at the start of and after the completion of the continuous prints.

Similarly, the image-forming apparatus was left standing for 24 hours in an environment of low temperature and low humidity (10° C., 15% RH), and then 3000 sheets of continuous prints were performed in the same environment and image quality was evaluated at the start of and after the completion of the continuous prints.

In the continuous prints, thin line image having a pixel rate of 6% (including three types of 4 lines/mm, 5 lines/mm, and 6 lines/mm), a halftone image (image density 0.40), white image, and solid image (image density 1.30) equally spaced in A4-size were outputted.

Fogging on the photosensitive member, fogging on the image, and variations in the image density were evaluated.

Fogging on the Photosensitive Member

After 3000 sheets of continuous prints were performed, the surface of the photosensitive member was visually observed to evaluate fogging on the photosensitive member, and after this visual observation, a book tape of 30 mm in width (Amenity B Coat T (made by Kihara Corp.)) was stuck on the surface of the photosensitive member and peeled off, and the peeled tape was stuck on a white paper and visually observed.

Evaluation was made according to the following criteria to be ranked as 4 grades. Symbols ⊙, ○, and Δ represent acceptance.

⊙: There is no fogging on the photosensitive member and on the peeled tape.

○: Fogging was slightly recognized on the photosensitive member, but fogging on the peeled tape was not recognized.

Δ: Fogging was recognized locally on the photosensitive member, but a degree of fogging was considered no problem practically from the state of the peeled tape.

x: Fogging was recognized throughout the photosensitive member, and it was judged that practically, there are problems on a degree of fogging from the state of the peeled tape.

Fogging on the Image

Fogging on the image was evaluated by the following method. Densities of 20 points of an white image on a print prepared at the start of continuous printing were measured using a densitometer "RD-918" made by GretagMacbeth AG, and an average of 20 points is defined as a white ground density. Next, image densities of 20 points of a white part of three thousandth sheet in the continuous prints were measured and an average of 20 points is defined as a white ground density of three thousandth sheet.

A value calculated by subtracting the white ground density at the start from the white ground density of three thousandth sheet was taken as a fogging density. An image having a fogging density of 0.010 or less was considered as acceptance.

⊙: less than 0.003;

○: 0.003 or more and less than 0.006;

Δ: 0.006 or more and 0.010 or less;

x: more than 0.010.

(Image Density)

Densities of solid images on a print at the start of continuous printing and a print of three thousandth sheet of the continuous prints were measured and evaluated. Specifically, densities of arbitrary 12 points on solid images on a print at the start of print preparation and on a print of three thousandth sheet were measured using a densitometer "RD-918 (made by GretagMacbeth AG)", and an average of 12 points is designated as an image density. A difference between the image density at the start of continuous printing and the image density of three thousandth sheet was calculated and evaluated. An image having the difference between both image densities of 0.04 or less was considered as acceptance.

⊙: less than 0.01;

○: 0.01 or more and less than 0.02;

Δ: 0.02 or more and 0.04 or less;

x: more than 0.04.

The results of evaluations are shown in Table 4.

TABLE 4

| | | Environment of high temperature and high humidity (30° C., 80% RH) | | | Environment of low temperature and low humidity (10° C., 15% RH) | | |
|---|---|---|---|---|---|---|---|
| | Developer number | Fogging (on photosensitive member) | Fogging (on image) | Image density | Fogging (on photosensitive member) | Fogging (on image) | Image density |
| Example 1 | 1 | ⊙ | ⊙ | ⊙ | ⊙ | ⊙ | ⊙ |
| Example 2 | 2 | ⊙ | ⊙ | ⊙ | ⊙ | ⊙ | ⊙ |
| Example 3 | 3 | ⊙ | ⊙ | ⊙ | ⊙ | ⊙ | ⊙ |
| Example 4 | 4 | ○ | ○ | ○ | Δ | ○ | ○ |
| Example 5 | 5 | ○ | ○ | ○ | ○ | ○ | ○ |
| Example 6 | 6 | Δ | ○ | ○ | ○ | ○ | ○ |
| Example 7 | 7 | ○ | ○ | ○ | Δ | ○ | ○ |
| Example 8 | 8 | ○ | ○ | ○ | ○ | ○ | ○ |
| Example 9 | 9 | Δ | ○ | ○ | ○ | ○ | ○ |
| Example 10 | 10 | ○ | ○ | ○ | Δ | ○ | Δ |
| Example 11 | 11 | ⊙ | ⊙ | ⊙ | ⊙ | ⊙ | ⊙ |
| Example 12 | 12 | Δ | ○ | ○ | ○ | ○ | ○ |
| Example 13 | 13 | Δ | ○ | Δ | Δ | ○ | Δ |
| Example 14 | 14 | ⊙ | ⊙ | ⊙ | ⊙ | ⊙ | ⊙ |
| Example 15 | 15 | ⊙ | ⊙ | ⊙ | ⊙ | ⊙ | ⊙ |
| Example 16 | 16 | Δ | Δ | Δ | Δ | Δ | Δ |
| Comparative Example 1 | 17 | Δ | Δ | Δ | X | X | X |
| Comparative Example 2 | 18 | Δ | Δ | Δ | X | Δ | X |
| Comparative Example 3 | 19 | X | Δ | Δ | ○ | ○ | ○ |
| Comparative Example 4 | 20 | X | Δ | Δ | X | X | X |
| Example 17 | 21 | ⊙ | ⊙ | ⊙ | ⊙ | ⊙ | ⊙ |
| Example 18 | 22 | ⊙ | ⊙ | ⊙ | ⊙ | ⊙ | ⊙ |
| Example 19 | 23 | ○ | ○ | ○ | ○ | ○ | ○ |
| Example 20 | 24 | ○ | ○ | ○ | ○ | ○ | ○ |
| Example 21 | 25 | ○ | ○ | ○ | ○ | ○ | ○ |
| Example 22 | 26 | ⊙ | ⊙ | ⊙ | ⊙ | ⊙ | ⊙ |
| Example 23 | 27 | ○ | ⊙ | ⊙ | ○ | ⊙ | ⊙ |
| Comparative Example 5 | 28* | X | X | X | Δ | Δ | ○ |

*Niobium oxide particle was also added as an external additive

Experiment Example 2

Mono-Component Developer Example/Comparative Example

Each toner described in Table 4 was loaded to a full color printer "magicolor 2300□L" (made by Konica Minolta Business Technologies, Inc.) of a non-magnetic mono component type as it is as a mono-component developer and the evaluation was made by following the same evaluation method as in the two-component developer in Experiment Example 1

TABLE 5

| | | Environment of high temperature and high humidity (30° C., 80% RH) | | | Environment of low temperature and low humidity (10° C., 15% RH) | | |
|---|---|---|---|---|---|---|---|
| | Toner number | Fogging (on photosensitive member) | Fogging (on image) | Image density | Fogging (on photosensitive member) | Fogging (on image) | Image density |
| Example 24 | 1 | ⊙ | ⊙ | ⊙ | ⊙ | ⊙ | ⊙ |
| Example 25 | 2 | ⊙ | ⊙ | ⊙ | ⊙ | ⊙ | ⊙ |
| Example 26 | 3 | ⊙ | ⊙ | ⊙ | ⊙ | ⊙ | ⊙ |
| Comparative Example 6 | 18 | Δ | Δ | Δ | X | Δ | X |
| Comparative Example 7 | 19 | X | Δ | Δ | ○ | ○ | ○ |

The invention claimed is:

1. A developer for electrophotography, comprising a toner; and composite oxide particles which includes metal titanate particles wherein the metal titanate particles contain titanium as a first metal atom, a second metal atom selected from the group consisting of the metal atoms belonging to Groups 1A and 2A of the long form of the Periodic Table of Elements, and 0.009 to 0.350% by weight of a third metal atom selected from the group consisting of the metal atoms belonging to Group 5A of the long form of the periodic table of elements.

2. The developer for electrophotography of claim 1, wherein the third metal atom is selected from the group consisting of V, Nb and Ta.

3. The developer for electrophotography of claim 1, wherein the second metal atom is selected from the group consisting of Mg, Ca, Sr and Ba.

4. The developer for electrophotography of claim 1, wherein a number average particle size of the composite oxide particles is 30 nm or more and 3000 nm or less and a standard deviation value of particle size is 1000 nm or less.

5. The developer for electrophotography of claim 1, wherein the third metal atom is Nb.

6. The developer for electrophotography of claim 1, wherein the second metal atom is Mg or Ca.

7. The developer for electrophotography of claim 1, wherein a number average particle size of the composite oxide particles is 50 nm or more and 2000 nm or less.

8. The developer for electrophotography of claim 1, wherein the developer for electrophotography contains a toner with an external additive added externally to toner particles as a first component, a carrier as a second component, and the composite oxide particles as a third component, the composite oxide particles are contained in at least one of the forms described below (A1) the composite oxide particles are added externally to the toner particles;

(A2) the composite oxide particles are added, internally to the toner particles;

(A3) the composite oxide particles are added internally to the carrier;

(A4) the composite oxide particles are added externally to the carrier; and (A5) the composite oxide particles are added to the developer as a third component.

9. The developer for electrophotography of claim 1, wherein the developer for electrophotography is a mono-component developer containing a toner with an external additive added externally to toner particles and the composite oxide particles are contained in at least one of the forms described below:

(B1) the composite oxide particles are added externally to the toner particles; and (B2) the composite oxide particles are added internally to the toner particles.

10. The developer for electrophotography of claim 8, wherein an acid value of the toner particles is 5 KOH mg/g or more and 30 KOH mg/g or less.

* * * * *